US007126279B2

(12) United States Patent
Okada et al.

(10) Patent No.: US 7,126,279 B2
(45) Date of Patent: Oct. 24, 2006

(54) DISPLAY PANEL WITH ELECTRON-EMITTING DEVICES ON SUBSTRATES AND CATHODE AND ANODE ELECTRODES

(75) Inventors: Takeru Okada, Yamanashi-ken (JP); Takashi Yamada, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 11/148,432

(22) Filed: Jun. 9, 2005

(65) Prior Publication Data

US 2005/0285525 A1 Dec. 29, 2005

(30) Foreign Application Priority Data

Jun. 10, 2004 (JP) ..... 2004-172956

(51) Int. Cl.
*H01J 17/49* (2006.01)

(52) U.S. Cl. ..... 313/582; 313/495

(58) Field of Classification Search ..... 313/495–497, 313/528–587
See application file for complete search history.

(56) References Cited

U.S. PATENT DOCUMENTS

| | | | | |
|---|---|---|---|---|
| 5,663,611 | A * | 9/1997 | Seats et al. | 313/584 |
| 5,729,094 | A * | 3/1998 | Geis et al. | 315/169.1 |
| 6,512,330 | B1 * | 1/2003 | Nakajima et al. | 313/586 |
| 2002/0171361 | A1 * | 11/2002 | Akiba | 313/582 |
| 2003/0146699 | A1 * | 8/2003 | Lee | 313/582 |
| 2005/0236964 | A1 * | 10/2005 | Kamide et al. | 313/495 |
| 2005/0258739 | A1 * | 11/2005 | Park et al. | 313/497 |

FOREIGN PATENT DOCUMENTS

JP 2001-6565 1/2001

* cited by examiner

*Primary Examiner*—Joseph Williams
*Assistant Examiner*—Hana Sanei
(74) *Attorney, Agent, or Firm*—McGinn IP Law Group,PLLC

(57) ABSTRACT

The front glass substrate and the back glass substrate are placed opposite each other with display cells in between. MIM electron-emitting devices each structured by the opposed cathode electrode and gate electrode sandwiching an insulator layer are arranged in matrix form on the inner face of the front glass substrate. An anode electrode and phosphor layers emitting visible light by being excited by ultraviolet light are provided on the inner face of the back glass substrate. The display cells are filled with an ultraviolet-light-emitting gas generating ultraviolet light by being excited by electrons.

19 Claims, 6 Drawing Sheets

SECTION VIII–VIII

FIRST EMBODIMENT

SECTION Ⅳ-Ⅳ

SECTION V-V

SECOND EMBODIMENT

THIRD EMBODIMENT

SECTION VIII-VIII

FOURTH EMBODIMENT

FIFTH EMBODIMENT

DISPLAY PANEL WITH ELECTRON-EMITTING DEVICES ON SUBSTRATES AND CATHODE AND ANODE ELECTRODES

BACKGROUND OF THE INVENTION

1. Field of the Invention

This invention relates to the structure of flat display panels.

The present application claims priority from Japanese Application No. 2004-172956, the disclosure of which is incorporated herein by reference.

2. Description of the Related Art

Conventionally, flat display panels include a PDP (Plasma Display Panel), an FED (Field Emission Display) and the like.

A color PDP is structured as illustrated in FIG. 1. That is, row electrode pairs (X, Y), a dielectric layer 2 covering the row electrode pairs (X, Y) and a protective layer 3 covering the dielectric layer 2 are provided on the rear-facing face of a front glass substrate 1. The front glass substrate 1 is placed opposite a back glass substrate 4 with the discharge space in between. Column electrodes D are provided on the inner face of the back glass substrate 4 and extend in a direction at right angles to the row electrode pairs (X, Y) so as to form discharge cells C in matrix form at positions corresponding to the intersections with the row electrode pairs (X, Y) in the discharge space. Further, on the inner face of the back glass substrate 4, a column-electrode protective layer 5 covers the column electrodes D. A partition wall unit 6 is formed on the column-electrode protective layer 5 to partition the discharge space into the discharge cells C. Red-, Green- and Blue-colored phosphor layers 7 are provided individually in the discharge cells C. The discharge space is filled with a discharge gas including xenon gas.

For generating an image on the panel surface in accordance with a video signal, the PDP initiates a discharge (sustaining discharge) between opposed transparent electrodes Xa and Ya on either side of a discharge gap g in each row electrode pair (X, Y) in order to generate vacuum ultraviolet light from the xenon gas in the discharge gas. The vacuum ultraviolet light excites the phosphor layers 7 and causes them to individually emit red-, green- and blue-colored visible light.

In the structure of the FED illustrated in FIG. 2, an anode electrode Ep and a transparent phosphor layer 11 are formed on the rear-facing face of a front glass substrate 10. A cathode electrode En, an insulation layer 13 covering the cathode electrode En, and a gate electrode Eg formed on the insulation layer 13 are formed on the front-facing face of a back glass substrate 12. The vacuum space between the front glass substrate 10 and the back glass substrate 12 is partitioned into pixels by a partition wall unit 14.

Regarding the FED, in the vacuum space in each pixel, drive voltage is applied between the anode electrode Ep and the cathode electrode En to generate an electric field enabling an electron beam to travel from the cathode electrode En toward the anode electrode Ep. The electron beam is accelerated by a gate electrode Eg to come into collision with the phosphor layer 11, whereby the phosphor layer 11 emits visible light to generate an image on the panel surface.

The PDP structured as described earlier needs a drive voltage of from 200V to 300V, for example, for enhancement of luminous efficiency. For this purpose, what is required, for example, is a semiconductor device for a high-voltage drive which is typically expensive. Such a requirement gives rise to the problem of high manufacturing costs.

The FED needs high voltage for its drive and therefore includes a complicated and high-cost drive circuit in the display device. Further, a high-velocity electron beam ionizes contaminated gas remaining within the panel. The ion impact at the time of this ionization causes wear and tear on the microchip array provided for generating the electron beam. As a result, the FED has the problem of a short lifetime.

The flat display panel, which is conventionally suggested in order to solve the problems associated with the structure of the PDP and FED, has the back substrate provided with an electron-emitting source emitting electrons by heat or an electric field, and the front substrate provided with anode electrodes accelerating the electron beam emitted from the electron-emitting source and phosphor layers covering the anode electrodes. The space between the front substrate and the back substrate is filled with xenon gas.

A conventional flat display panel structured as described above is disclosed in Japanese unexamined patent publication 2001-6565, for example.

In the conventional flat display panel, the electrons emitted from the electron-emitting source provided on the back substrate are accelerated by a voltage applied to the anode electrode. The accelerated electrons directly excite the xenon gas filling the space defined between the front substrate and the back substrate to cause the xenon gas to emit ultraviolet light. The ultraviolet light excites the phosphor layers formed on the front substrate to cause the phosphor layers to emit visible light, resulting in the generation of an image.

However, the conventional flat display panel has the following problems.

In the conventional flat display panel, the electrons emitted from the electron-emitting source are accelerated by anode voltage in the space filled with xenon gas. Therefore, unlike the acceleration of electrons in a vacuum space, the accelerated electrons come into inelastic collision with the xenon gas filling the space to lose energy, and then the electrons are re-accelerated by anode voltage. This phenomenon occurs repeatedly.

There is no regularity in the inelastic collision between the electrons and the Xenon gas. The time period and the migration length from the time when the electrons come into inelastic collision with the xenon gas and lose velocity energy to the time when the electrons are re-accelerated by the anode voltage are not constant. Therefore, the velocity energy distribution of the electrons is widened. As a result, the difficulty arises of making the electrodes efficiently come into collision with the xenon gas for the generation of vacuum ultraviolet light.

Further, the higher the gas pressure of the xenon gas in the space, the more involved the inelastic collision between the electrons and the xenon gas. For this reason, a high anode voltage is required for accelerating the electrons under the high gas pressure of the xenon gas. However, if a high anode voltage is set, electrons having a higher energy than the energy necessary for ionizing the xenon gas appear. The xenon gas is ionized, thereby disadvantageously reducing the efficiency of the excitation of the xenon gas.

A high anode voltage causes the further problems of continuously producing a discharge between the electron-emitting source and the anode electrode and of a back-scatter phenomenon in which the electrons are forced back toward the electron-emitting source by the elastic collision with the xenon gas.

In consequence, the conventional flat display panel has the problem of the impossibility of a satisfactory improvement of the luminous efficiency because of the impossibility of building up the gas pressure of the xenon gas filling the space between the front substrate and the back substrate and thus the impossibility of preventing the widening of the velocity energy distribution of electrons.

SUMMARY OF THE INVENTION

It is an object of the present invention to solve the problems associated with the conventional flat display panel as described above.

To attain this object, the present invention provides a display panel that has a pair of opposed first and second substrates placed on either side of a required space, electron-emitting devices provided in matrix form between the pair of first and second substrates to emit electrons into the space, an anode electrode, phosphor layers emitting visible light by being excited by ultraviolet light, the space between the pair of first and second substrates being filled with an ultraviolet-light-generating gas generating ultraviolet light by being excited by the electrons. Each of the electron-emitting devices is structured by a cathode electrode emitting high energy electrons of 7 eV to 12 eV; a gate electrode; and an insulator sandwiched between the cathode electrode and the gate electrode.

In the best mode for carrying out the present invention, a display panel has a plurality of cathode electrodes each extending in the row direction and regularly arranged in the column direction on the inner face of a front glass substrate, and an insulator layer covering the cathode electrodes. A plurality of gate electrodes each extend in the column direction and are regularly arranged in the row direction on the back-facing face of the insulator layer. An anode electrode(s) is provided on either the inner face of the front glass substrate or the back substrate. MIM electron-emitting devices are formed in the intersections of the cathode electrodes and the gate electrodes with the insulator layer in between, and arranged in matrix form on the panel surface. The anode electrode and phosphor layers are provided on the back glass substrate. An ultraviolet-light-generating gas fills the space defined between the front glass substrate and the back glass substrate.

In the display panel according to this best mode, drive voltage is selectively applied to the cathode electrodes and the gate electrodes which are provided on the front glass substrate. Thereupon, an electric field is created in the intersections between the cathode electrodes and the gate electrode to which the drive voltage is applied, and due to the anode electrode, electrons are emitted into the space between the front glass substrate and the back glass substrate.

The electrons emitted from the MIM electron-emitting devices directly excite the ultraviolet-light-generating gas in the space and enables this gas to generate vacuum ultraviolet light. The vacuum ultraviolet light excites the phosphor layers and thus the phosphor layers generate visible light to from an image.

As described above, the MIM electron-emitting device accelerates electrons, before the emission, inside the device without almost scattering by the application of the drive voltage between the cathode electrode and the gate electrode which face each other on either side of the insulation layer. For this reason, the MIM electron-emitting device is capable of emitting electrons having high velocity energy and not widening the energy distribution.

Accordingly, the display panel is capable of efficiently generating vacuum ultraviolet light from xenon gas and improving the luminous efficiency. Further, the build-up of the gas pressure of the ultraviolet-light-generating gas is possible, which in turn brings about, for example, a reduction in ion sputtering, a reduction in the effect of the contaminated gas, and the prevention of the emitted electrons from reaching the anode electrode without exciting the ultraviolet-light-generating gas. In consequence, it is possible to enhance the life time and improve the luminous efficiency of the display panel.

These and other objects and features of the present invention will become more apparent from the following detailed description with reference to the accompanying drawings.

DETAILED DESCRIPTION OF THE PREFERRED EMBODIMENTS

First Embodiment

Figure 1:
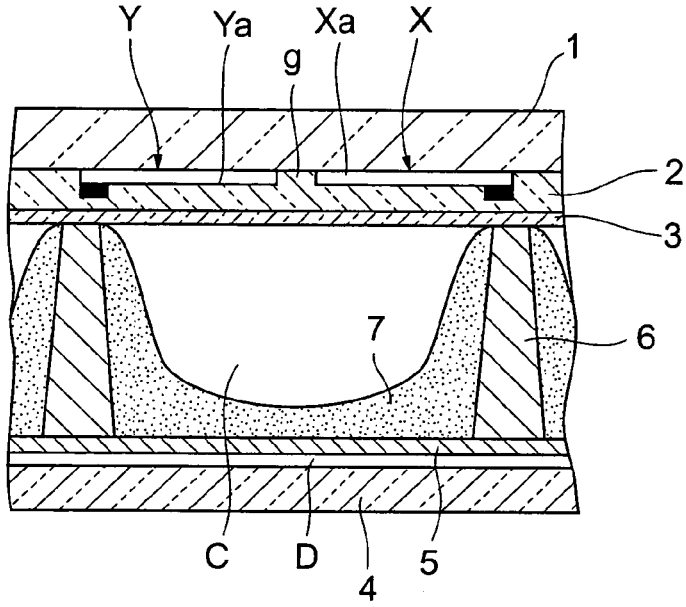
Fig.1 RELATED ART
FIG. 1 is a sectional view illustrating the structure of a conventional PDP.
Figure 2:
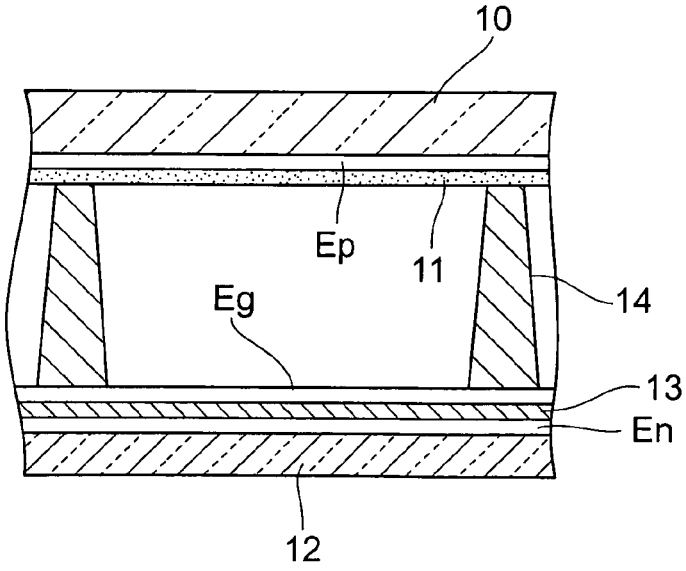
Fig.2 RELATED ART
FIG. 2 is a sectional view illustrating the structure of a conventional FED.
Figure 3:
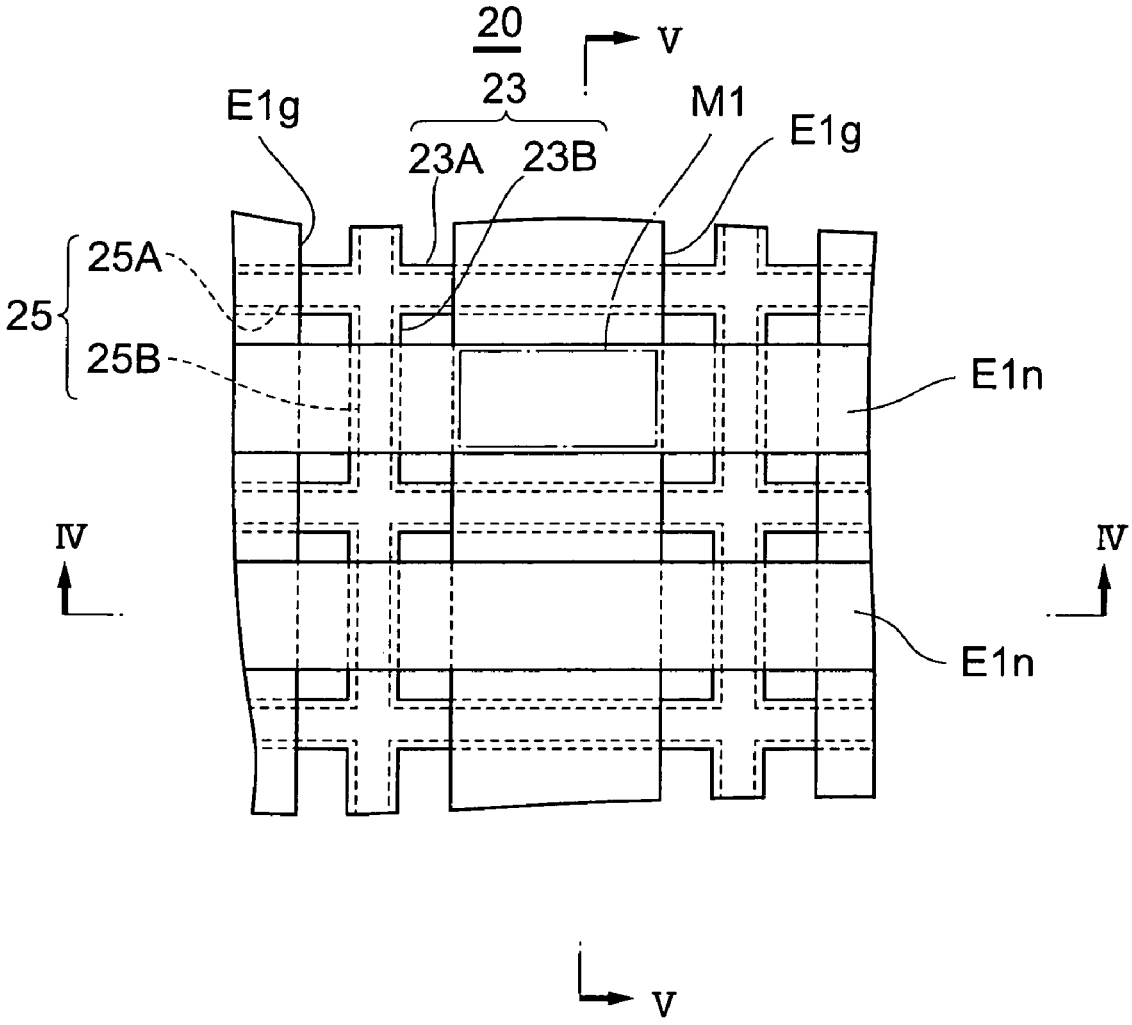
FIG. 3 is a front view illustrating a first embodiment according to the present invention.
Figure 4:
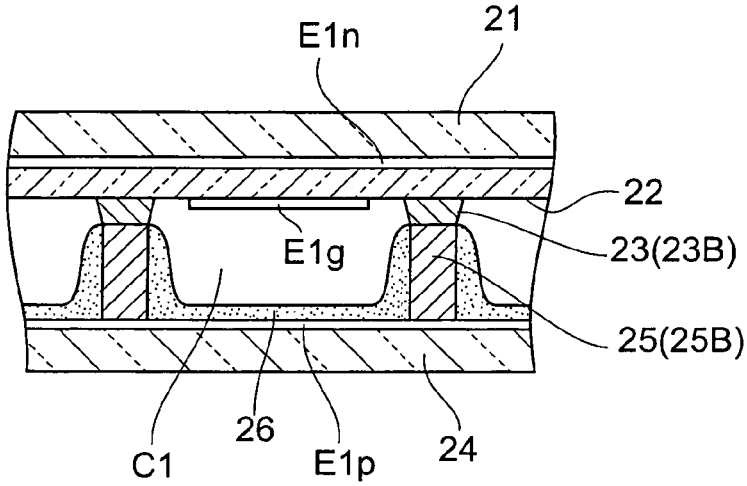
FIG. 4 is a sectional view taken along the IV—IV line in FIG. 3.
Figure 5:
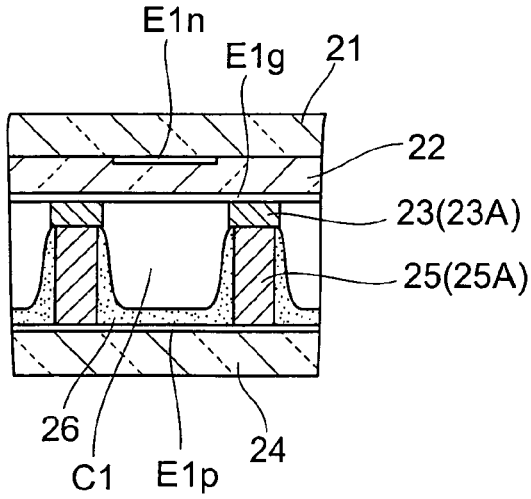
FIG. 5 is a sectional view taken along the V—V line in FIG. 3.

FIGS. 3 to 5 illustrate a first embodiment of the display panel according to the present invention. FIG. 3 is a schematic front view of the structure of the display panel in the first embodiment. FIG. 4 is a sectional view taken along the IV—IV line in FIG. 3. FIG. 5 is a sectional view taken along the V—V line in FIG. 3.

The display panel 20 shown in FIGS. 3 to 5 has a front glass substrate 21 serving as the display surface. Transparent cathode electrodes E1*n* each having a bar shape and extending in a row direction (the right-left direction in FIG. 3) are spaced at regular intervals from each other in a column direction (the vertical direction in FIG. 3) on the back-facing face of the front glass substrate 21.

The cathode electrodes E1*n* are formed of Cr, Al, Ag, Cu, Ni, ITO, $SnO_2$, or ZnO, for example.

An insulation layer 22 is further formed on the back-facing face of the front glass substrate 21 and covers the cathode electrodes E1*n*.

The insulation layer 22 is formed of Si or SiOx, for example.

Transparent gate electrodes E1*g* each having a bar shape and extending in the column direction are spaced at regular intervals from each other in the row direction on the back-facing face of the insulation layer 22.

The gate electrodes E1*g* are formed of W, C, Pt, Au, C, ITO, $SnO_2$, or ZnO, for example.

An additional dielectric layer 23 is formed on the back-facing face of the insulation layer 22. The additional dielectric layer 23 is formed in a grid shape made up of lateral additional portions 23A each extending in the row direction in a strip opposite the mid-position between adjacent cathode electrodes E1*n*, and vertical additional portions 23B each extending in the column direction in a strip opposite the mid-position between adjacent gate electrodes E1*g*.

The front glass substrate 21 is placed opposite and parallel to a back glass substrate 24 with a space in between. An anode electrode E1*p* is formed on the entire front-facing face of the back glass substrate 24 facing toward the display surface.

A partition wall unit 25 is formed on the anode electrode E1*p*. The partition wall unit 25 is formed in an approximate grid shape made up of lateral walls 25A each extending in the row direction opposite the lateral additional portion 23A of the additional dielectric layer 23, and vertical walls 25B each extending in the column direction opposite the vertical additional portion 23B. The partition wall unit 25 partitions the space between the front glass substrate 21 and the back glass substrate 24 into areas corresponding to the intersections between the cathode electrodes E1*n* and the gate electrodes E1*g* so as to form display cells C1.

Red-, Green- and Blue-colored phosphor layers 26 are formed between the lateral walls 25A and the vertical walls 25B of the partition wall unit 25. In each display cell C1, each of the red-, green- and blue-colored phosphor layers 26 covers the five faces facing the display cell C1, the front-facing face of the anode electrode E1*p* and the side faces of the lateral walls 25A and the vertical walls 25B.

Each of the display cells C1 is vacuumed and then filled with an ultraviolet-light-generating gas for the generation of ultraviolet light.

The kinds of gas used as the ultraviolet-light-generating gas include 100% xenon (Xe), a gas mixture of xenon (Xe) and mercury (Hg), a gas mixture of xenon (Xe) and neon (Ne), for example.

In the foregoing structure, in preparation for the ionization of the ultraviolet-light-generating gas, the gate electrode Eg1 may be covered by a thin protective layer formed of MgO, BaO, SrO, CaO, $Cs_2O$, $Cs_2$, $CO_3$, $Gd_2O_3$, $La_2O_3$, ZrC, HfC, DLC, for example.

The display panel 20 has MIM (Metal-Insulation-Metal) electron-emitting devices each formed in an area (emission site) Ml in which the cathode electrode E1*n* and the gate electrode E1*g* which extend in directions crossing each other sandwich the insulation layer 22 on the front glass substrate 21. The MIM electron-emitting devices are arranged in matrix form on the panel, and respectively face the display cells C1 in which the red-, green- and blue-colored phosphor layers 26 are individually provided.

The display panel 20 applies drive voltage selectively to the cathode electrodes E1*n* and the gate electrodes E1*g*. An electric field is produced at each of the intersections of the cathode electrodes E1*n* and the gate electrodes E1*g* to which the drive voltage is applied, whereupon electrons are emitted into the display cell C1 toward the anode electrode E1*p* provided on the back glass substrate 24.

The electrons thus emitted from each of the MIM electron-emitting devices directly excite the xenon gas included in the ultraviolet-light generating gas filling the display cell C1 to cause the generation of vacuum ultraviolet light. The vacuum ultraviolet light excites the phosphor layer 26 provided in the display cell C1 to produce red, green or blue visible light.

In this manner, an image according to a video signal is generated on the panel surface by means of the combination of the red, green and blue visible light emitted from the phosphor layers 26.

In the generation of the image, the electrons to be emitted are accelerated inside the MIM electron-emitting device without being almost scattered by the application of the drive voltage between the cathode electrode E1*n* and the gate electrode E1*g* which face each other on either side of the insulation layer 22. For this reason, the MIM electron-emitting device is capable of emitting electrons having a velocity energy of, for example, 7 eV to 12 eV (a value roughly the result of subtracting the work function from the applied voltage) and not widening the energy distribution.

Therefore, when the MIM electron-emitting device is set to emit electrons having a peak energy corresponding to the ultraviolet-emission energy (about 8.5 eV) of xenon gas, the xenon gas can be efficiently and directly excited for the generation of vacuum ultraviolet light.

Further, the electrons emitted from the MIM electron-emitting device have high velocity energy and a satisfactory property of traveling straight ahead. This has the advantage of minimizing the occurrence of a back-scatter phenomenon in which the electrons are forced back toward the gate electrode E1*g* by the elastic collision with the xenon included in the ultraviolet-light-generating gas. As a result, a build-up of the gas pressure of the ultraviolet-light-generating gas in the display cell C1 becomes possible.

In turn, the build-up of the gas pressure of the ultraviolet-light-generating gas in the display cell C1 brings about, for example, a reduction in ion sputtering, a reduction in the effect of the contaminated gas, and the prevention of the electrons emitted from the MIM electron-emitting device from reaching the anode electrode E1*p* without coming into collision with the xenon in the ultraviolet-light-generating gas. In consequence, it is possible to enhance the life time and improve the luminous efficiency of the display panel 20.

As described hitherto, with the display panel 20, the electrons emitted from each of the MIM electron-emitting devices are capable of exciting the ultraviolet-light-generating gas for the generation of vacuum ultraviolet light, without being affected by the acceleration caused by the anode electrode E1*p* and by the gas pressure of the ultraviolet-light-generating gas in the display cell C1. In consequence, the efficiency of generating vacuum ultraviolet light, namely, the luminous efficiency of the phosphor layer 26, is improved to make the generation of an image with high brightness possible.

The conventional display panels are incapable of increasing the thickness of the phosphor layer because of the transmission-type structure in which the phosphor layer is provided on the front substrate. Therefore, an increase in the percentage of use of the vacuum ultraviolet light generated from the ultraviolet-light-generating gas has so far been impossible. However, in the foregoing display panel 20, because of the reflection type structure in which the phosphor layer 26 is provided on the back glass substrate 24, the enhancement of the luminous efficiency of the phosphor layer is made possible by increasing the thickness of the phosphor layer 26 to increase the percentage of use of the vacuum ultraviolet light.

Further, the display cells C1 of the display panel 20 are defined by the grid-shaped partition wall unit 25. This makes it possible to prevent mixing of the colors of the red, green and blue phosphor layers 26 and the occurrence of light leakage between adjacent display cells C1, leading to an improvement of the resolution in the horizontal direction and the vertical direction of the image.

Still further, the area of coating with phosphor is increased because the phosphor layer 26 is formed in such a manner as to cover the side faces of the partition wall unit 25, thereby achieving the emission of high intensity light.

In the first embodiment, the thickness of the portions of the dielectric layer 22 corresponding to the emission sites Ml may be thinner than that of the other portions of the dielectric layer 22. This design allows the emission of electrons only from the emission site Ml.

Further, in the first embodiment, an MIM electron-emitting device is used as the electron-emitting device. However, instead of the MIM electron-emitting device, various electron-emitting devices can be used, for example: an SIM (Silicon Insulator Metal) electron-emitting device in which a semiconductor layer formed of Si or the like, an insulator layer formed of $SiO_2$ or the like and a gate electrode are laminated in order on a cathode electrode; a BSD (Ballistic electron Surface-emitting Device) electron-emitting device in which an insulator layer that is formed of $SiO_2$ or the like and has a semiconductor of Si or the like implanted therein, and a gate electrode are laminated in order on a cathode electrode; an SED electron-emitting device in which a cathode electrode, a gate electrode, and an insulation layer sandwiched between the opposed cathode electrode and gate electrode are provided on the same face of the substrate; an electron-emitting device having a structure in which a gate electrode and an anode are combined for use: or any electron-emitting device capable of emitting electrons having high energy of 7 eV to 12 eV.

Second Embodiment

Figure 6:
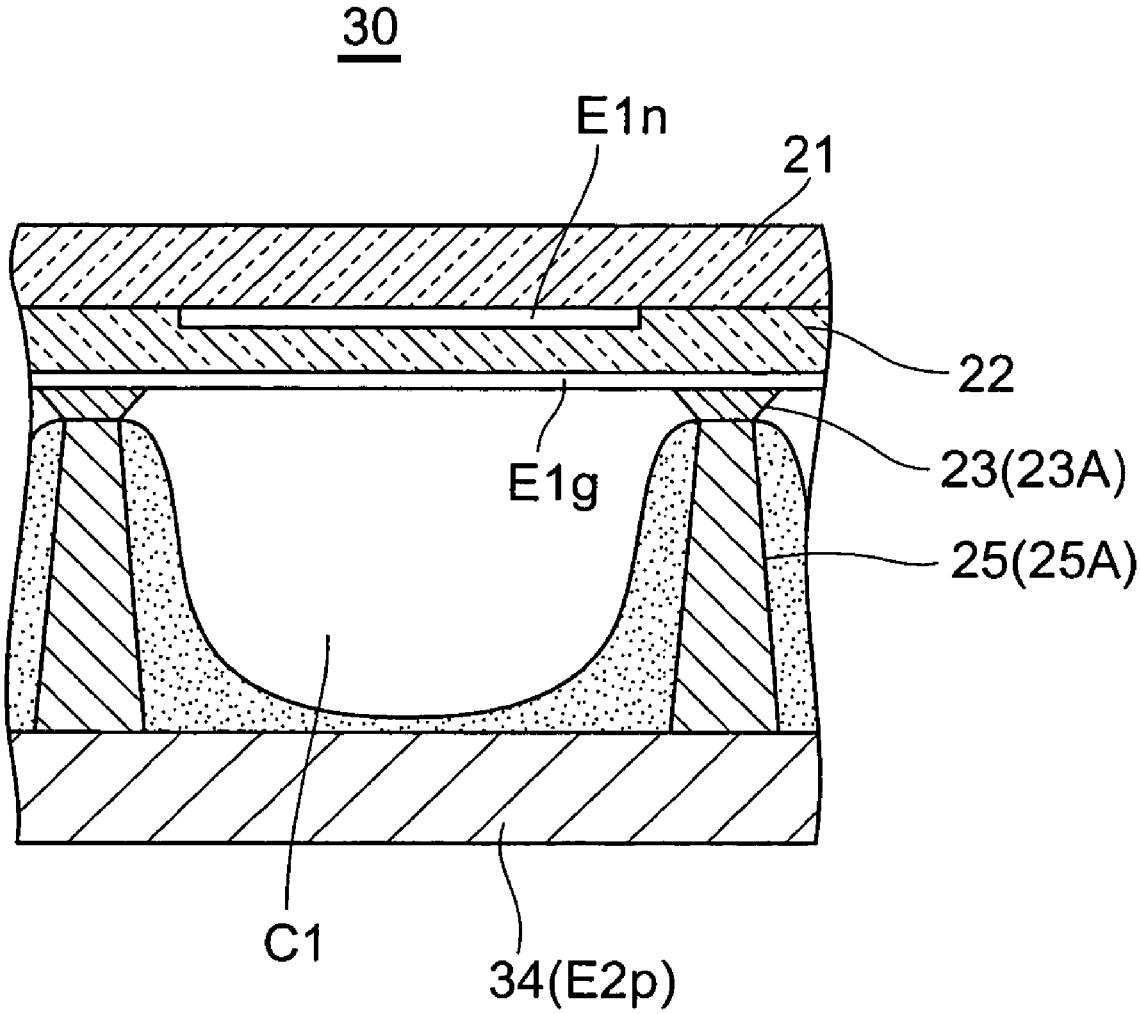
FIG. 6 is a sectional view illustrating a second embodiment of the present invention.

FIG. 6 is a sectional view illustrating a second embodiment of the display panel according to the present invention.

The sectional view of FIG. 6 shows the display panel taken in the same direction as the sectional view of FIG. 5.

Instead of the back glass substrate 24 in the first embodiment, the display panel 30 in the second embodiment has a metal-made back substrate 34 placed opposite the front glass substrate 21. The metal-made back substrate 34 serves as an anode electrode E2*p*.

The structure of the other components in the second embodiment is the same as that in the display panel 20 in the first embodiment, and the same components are designated with the same reference numerals as those in the first embodiment.

In addition to the same effects and advantages as those of the display panel 20 in the first embodiment, the display panel 30 makes it possible to omit from the manufacturing process the process for forming the anode electrode and to simplify the display panel, because the metal-made back substrate 34 serves as the anode electrode.

In the second embodiment, the partition wall unit can be structured as a metallic partition wall unit formed integrally with the metal-made back substrate 34.

Third Embodiment

Figure 7:
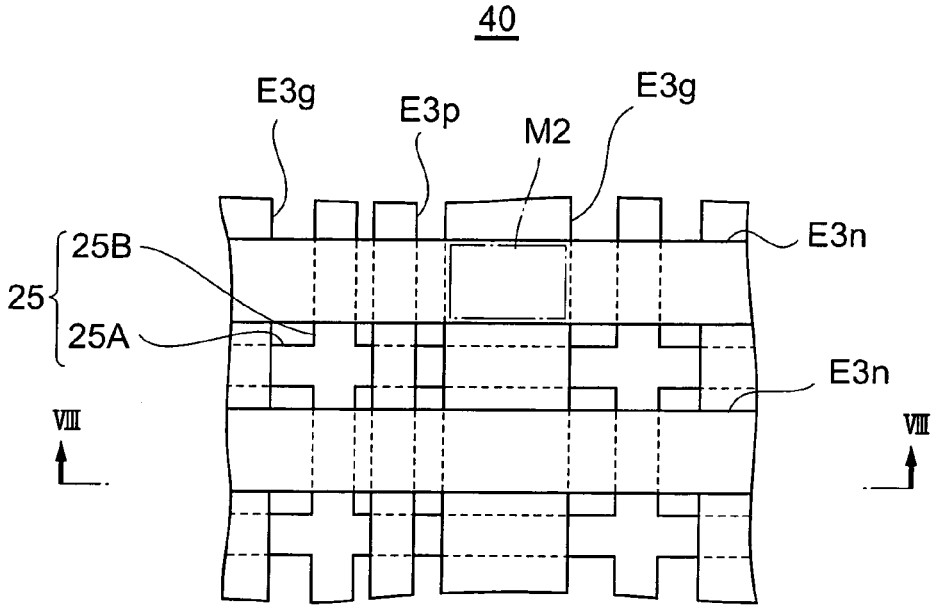
FIG. 7 is a front view illustrating a third embodiment of the present invention.
Figure 8:
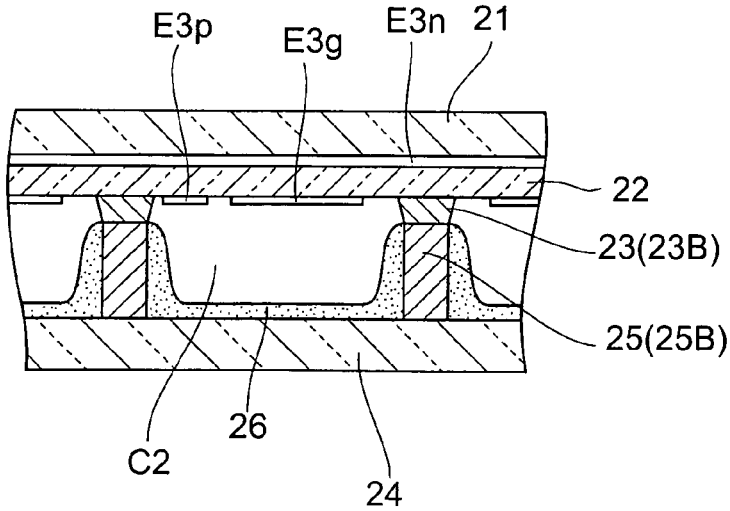
FIG. 8 is a sectional view taken along the VIII—VIII line in FIG. 7.

FIGS. 7 and 8 illustrate a third embodiment of the display panel according to the present invention. FIG. 7 is a schematic front view of the structure of the display panel in the third embodiment. FIG. 8 is a sectional view taken along the line VIII–VIII in FIG. 7.

The display panel 40 shown in FIGS. 7 and 8 is structured such that anode electrodes E3*p* are provided on the front glass substrate 21, in contrast to the provision of the anode electrode E1*p* of the display panel 20 on the back glass substrate 24 in the first embodiment.

More specifically, transparent cathode electrodes E3*n* each formed in a bar shape and extending in the row direction are regularly spaced from each other at predetermined intervals in the column direction on the back-facing face of the front glass substrate 21 serving as the display surface. The insulation layer 22 is provided on the back-facing face of the front glass substrate 21 and covers the cathode electrodes E3*n*.

Transparent gate electrodes E3*g* each formed in a bar shape and extending in the column direction are regularly spaced at predetermined intervals in the row direction on the back-facing face of the insulation layer 22.

On the back-facing face of the insulation layer 22, further, the transparent anode electrodes E3*p* each formed in a bar shape are spaced at regular intervals. Each of the anode electrodes E3*p* extends in the column direction parallel to the gate electrode E3*g* at a required interval.

The structure of the other components of the display panel 40 is approximately the same as that of the display panel 20 in the first embodiment, except for the fact that the anode electrode is provided on the back glass substrate 24. The same components of the display panel 40 as those of the display panel 20 are designated with the same reference numerals.

In addition to the same effects and advantages as those of the display panel 20 in the first embodiment, the display panel 40 has the advantage of facilitating the alignment of the relative positioning between electrodes because the anode electrodes E3*p* together with the cathode electrodes E1*n* and the gate electrodes E3*g* are provided on the front glass substrate 21.

In the third embodiment, the back substrate may be formed as a metallic back substrate, and the partition wall unit may be a metallic partition wall unit formed integrally with the back substrate.

Fourth Embodiment

Figure 9:
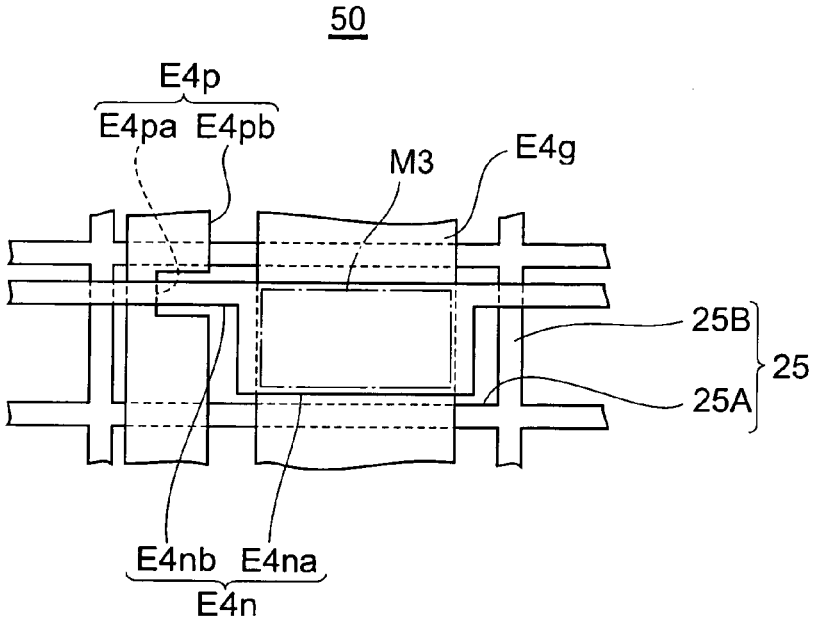
FIG. 9 is a front view illustrating a fourth embodiment of the present invention.

FIG. 9 is a schematic front view illustrating the structure of a display panel of a fourth embodiment of the display panel according to the present invention.

As in the case of the display panel 30 of the third embodiment, the display panel 50 illustrated in FIG. 9 is structured such that the anode electrodes, together with the cathode electrodes and the gate electrodes, are provided on the front glass substrate. Each of the cathode electrodes E4*n* has portions E4*na* and bar-shaped portions E4*nb*. Each of the portions E4*na* faces the gate electrode E4*g* and has the width in the column direction larger than that of the bar-shaped portion E4*nb*. An emission site M3 is formed in the wider portion E4*na*.

Each of the anode electrodes E4*p* is spaced parallel to the gate electrode E4*g* at a required interval, and has portions E4*pa* and bar-shaped portions E4*pb*. Each of the portions E4*pa* faces the bar-shaped narrower portion E4*nb* of the cathode electrode E4*n*, and has the width in the column direction smaller than that of the bar-shaped portion E4*pb* of the anode electrode E4*p*.

The structure of the other components in the fourth embodiment is the same as that of the display panel 20 in the first embodiment, and the same components are designated with the same reference numerals.

In addition to the same effects and advantages as those of the display panel 20 in the first embodiment, the display panel 50 in the fourth embodiment shows improvement in the luminous efficiency. This is because the cathode electrode E4*n* has the wider portion E4*na* facing the gate electrode E4*g* to form the emission site M3, so that the increased area of the emission site M3 increases the intensity of the electric field produced between the cathode electrode E4*n* and the gate electrode E4*g*, resulting in an increase in the number of electrons emitted.

The cathode electrode E4*n* and the anode electrode E4*p* have their narrow portions (the bar-shaped portion E4*nb* of the cathode electrode E4*n* and the narrow portion E4*pa* of the anode electrode E4*p*) facing each other to reduce the opposed area. Thereby, the creation of an electric field in any area other than the emission sites M3 is restrained.

In the fourth embodiment, the portions of the insulation layer corresponding to the emission sites M3 are thinner than the other portions of the insulation layer, thereby making it possible to emit the electrons only from the emission sites M3.

Fifth Embodiment

Figure 10:
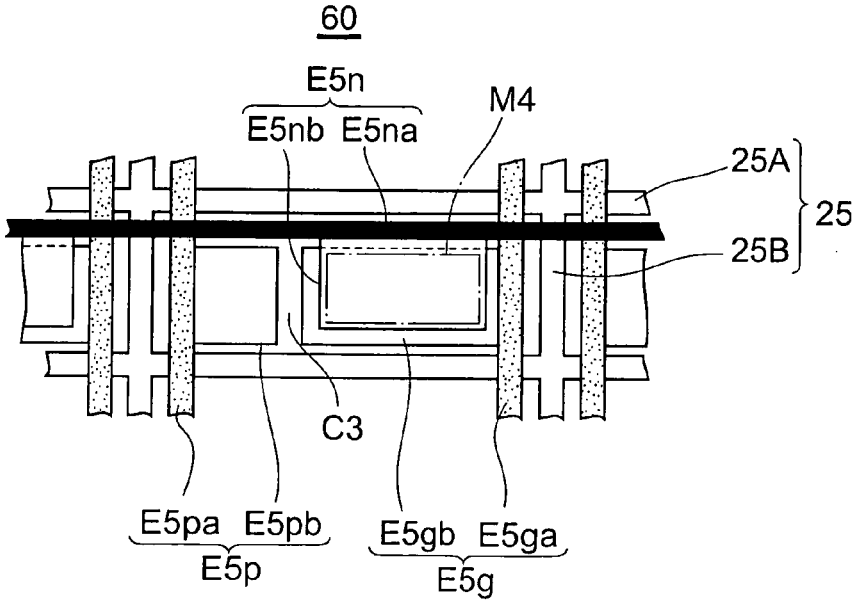
FIG. 10 is a front view illustrating a fifth embodiment of the present invention.

FIG. 10 is a schematic front view of the structure of a display panel in a fifth embodiment of the display panel according to the present invention.

As in the case of the display panel 40 in the third embodiment, the display panel 60 shown in FIG. 10 is structured such that the anode electrodes together with the cathode electrodes and the gate electrodes are provided on the front glass substrate. The anode electrodes, the cathode electrodes and the gate electrodes are all composed of a bus electrode extending in bar form and transparent protruding electrodes each extending out from the associated bus electrode for each display cell.

More specifically, each of the cathode electrodes E5*n* is composed of a bar-shaped cathode bus electrode E5*na* and transparent cathode protruding electrodes E5*nb* each having a broad width. The cathode bus electrode E5*na* extends, in the row direction, opposite a strip next to ("below" in FIG. 10) the lateral wall 25A of the partition wall unit 25. For each display cell C3, each of the cathode protruding electrodes E5*nb* extends out from the cathode bus electrode E5*na* toward the position facing the approximate center of the display cell C3.

Each of the gate electrodes E5*g* is composed of a bar-shaped gate bus electrode E5*ga* and transparent gate protruding electrodes E5*gb* each having a broad width. The gate bus electrode E5*ga* extends, in the column direction, opposite a strip on one side of the vertical wall 25B of the partition wall unit 25 ("on the left-hand side" in FIG. 10). For each display cell C3, each of the gate protruding electrodes E5*gb* extends out from the gate bus electrode E5*ga* toward the position facing the cathode protruding electrode E5*nb* of the cathode electrode E5*n* facing the approximate center of the display cell C3.

Each of the anode electrodes E5*p* is composed of a bar-shaped anode bus electrode E5*pa* and transparent anode protruding electrodes E5*pb* each having a broad width. The anode bus electrode E5*pa* extends, in the column direction, opposite a strip on the other side of the vertical wall 25B of the partition wall unit 25 from the gate bus electrode E5*ga* ("on the right-hand side" in FIG. 10). For each display cell C3, each of the anode protruding electrodes E5*pb* extends out from the anode bus electrode E5*pa* toward an area which is in the vicinity of the approximate central portion of the display cell C3 and does not face the cathode bus electrode E5*na* and the cathode protruding electrodes E5*nb* of the cathode electrode E5*n* and the gate bus electrode E5*ga* and the gate protruding electrodes E5*gb* of the gate electrode E5*g*.

The structure of the other components in the fifth embodiment is the same as that of the display panel 20 in the first embodiment, and the same components are designated with the same reference numerals.

In addition to the same effects and advantages as those of the display panel 20 in the first embodiment, the display panel 60 in the fifth embodiment shows improvement in luminous efficiency. This is because each of the electrodes is composed of a bus electrode extending in a bar shape and transparent protruding electrodes extending out from the bus electrode for each display cell C3. In the area facing each display cell C3, the wider cathode protruding electrode E5*nb* faces the gate protruding electrode E5*gb* to form an emission site M4, so that the increased area of the emission site M4 increases the intensity of the electric field produced between these electrodes, resulting in an increase in the number of electrons emitted.

The cathode electrode E5*n* and the anode electrode E5*p* have the narrow cathode bus electrode E5*na* and the narrow anode bus electrode E5*pa* facing each other to reduce the opposed area. Thereby, the creation of an electric field in any area other than the emission sites M4 is restrained.

In the fifth embodiment, the portions of the insulation layer corresponding to the emission sites M4 are smaller in thickness than the other portions of the insulation layer, thereby making it possible to emit the electrons only from the emission sites M4.

The terms and description used herein are set forth by way of illustration only and are not meant as limitations. Those skilled in the art will recognize that numerous variations are possible within the spirit and scope of the invention as defined in the following claims.

What is claimed is:

1. A display panel, comprising:

a pair of opposed first and second substrates placed on either side of a required space;

electron-emitting devices each comprising a cathode electrode emitting high energy electrons of 7 eV to 12 eV, a gate electrode, and an insulator sandwiched between the cathode electrode and the gate electrode, and provided in matrix form between the pair of first and second substrates to emit electrons into the space;

an anode electrode;

phosphor layers emitting visible light by being excited by ultraviolet light; and an ultraviolet-light-generating gas filling the space between the pair of first and second substrates and generating ultraviolet light by being excited by the electrons;

wherein the electron-omitting devices are provided on an inner face of the first substrate of the pair of first and second substrates serving as the display surface of the panel, wherein on the inner face of the first substrate, the cathode electrodes each extend in a first direction along either width or length of the first substrate and are regularly arranged in a second direction along either width or length of the first substrate at right angles to the second direction, the gate electrodes each extend in the second direction and are regularly arranged in the first direction, an insulator layer is interposed between the cathode electrodes and the gate electrodes, and each of the electron-emitting devices is formed in each of the intersections of the cathode electrodes and the gate electrodes with the insulator layer in between, wherein each of the cathode electrodes, extending in the first direction of the substrate, has portions facing the gate electrode and each having a width larger in the second direction of the substrate than that of the other portions of the cathode electrode, and wherein the anode electrode extends parallel to the gate electrode on a back-face facing of the insulator layer covering the cathode electrodes, and the anode electrode intersects with the portions of the cathode electrodes each having the width smaller than that of the portion facing the gate electrode, with the insulator layer being interposed between the anode electrode and the portion of the cathode electrode.

2. A display panel according to claim 1, wherein portions of the insulator layer sandwiched between the cathode electrodes and the gate electrodes in the intersections of the cathode electrodes and the gate electrodes are smaller in thickness than portions of the insulator layer which are not sandwiched.

3. A display panel according to claim 1, wherein the anode electrode is provided on the inner face of the second substrate serving as the back face of the panel.

4. A display panel according to claim 1, wherein the phosphor layer is provided on the inner face of the second substrate serving as the back face of the panel.

5. A display panel according to claim 1, further comprising a partition wall unit formed in an approximate grid shape and provided between the pair of first and second substrates to partition the space between the pair of first and second substrates into areas each facing the electron-emitting device to form unit display areas, wherein the phosphor layers to which red, green and blue colors are individually applied are respectively formed in the unit display areas.

6. A display panel according to claim 5, wherein the partition wall unit is provided on the second substrate serving as the back face of the panel, further comprising, an additional insulation layer formed in an approximate grid shape and extending out from a portion of the inner face of the first substrate serving as the display surface of the panel corresponding to the partition wall unit toward the space between the pair of first and second substrates, wherein the additional insulation layer and the partition wall unit are in contact with each other to block adjacent unit display areas from each other.

7. A display panel according to claim 1, wherein the second substrate serving as the back face of the panel comprises a metallic substrate and serves as the anode electrode.

8. A display panel according to claim 7, further comprising a metallic partition wall unit formed in an approximate grid shape and provided between the pair of first and second substrates to partition the space between the pair of first and second substrates into areas each facing the electron-emitting device, wherein the metallic partition wall unit is formed integrally with the metallic substrate.

9. A display panel according to claim 1, wherein the ultraviolet-light-generating gas is either xenon or a gas mixture including xenon.

10. A display panel according to claim 9, wherein the ultraviolet-light-generating gas includes mercury.

11. A display panel according to claim 9, wherein the ultraviolet-light-generating gas includes neon.

12. A display panel according to claim 1, wherein the electrons emitted from each of the electron-emitting devices has an energy distribution having a peak of 8.5 eV.

13. A display panel according to claim 1, wherein the anode electrode is provided on an inner face of the first substrate serving as the display surface of the panel.

14. A display panel according to claim 13, wherein the anode electrode extends parallel to the gate electrode on a back-face facing of the insulator layer covering the cathode electrodes.

15. A display panel according to claim 1, wherein portions of the anode electrode intersecting with the cathode electrodes with the insulator layer in between each have a width in the first direction of the substrate smaller than that of the other portions of the anode electrode.

16. A display panel according to claim 1, wherein each of the cathode electrodes has a bus electrode extending in the first direction of the substrate and protrusion electrodes extending out from required portions of the bus electrode in the second direction of the substrate, and each of the protrusion electrodes of the cathode electrode faces the gate electrode with the insulator layer in between.

17. A display panel according to claim 1, wherein each of the gate electrodes has a bus electrode extending in the second direction of the substrate and protrusion electrodes extending out from required portions of the bus electrode in the first direction of the substrate, and each of the protrusion electrodes of the gate electrode faces the cathode electrode with the insulator layer in between.

18. A display panel according to claim 1, wherein the anode electrodes are provided in plurality and each of the anode electrodes has a bus electrode extending in a second direction along either a width or a length of the substrate and protrusion electrodes extending out from required portions of the bus electrode in a first direction along the either the width or the length of the substrate at right angles to the second direction.

19. A display panel according to claim 1, wherein the gate electrodes are covered by a protective layer.

* * * * *